US005630549A

United States Patent [19]

Le

[11] Patent Number: 5,630,549

[45] Date of Patent: May 20, 1997

[54] ADJUSTABLE, STACKABLE WATER SPRINKLER HEAD

[76] Inventor: Thong H. Le, 3041 Sierra Rd., San Jose, Calif. 95132

[21] Appl. No.: 638,857

[22] Filed: Apr. 29, 1996

Related U.S. Application Data

[63] Continuation of Ser. No. 309,352, Sep. 20, 1994, abandoned.

[51] Int. Cl.[6] ..... B05B 1/32; B05B 1/14

[52] U.S. Cl. ..... 239/451; 239/551; 239/554; 239/DIG. 1

[58] Field of Search ..... 239/207, 266, 239/268, 390–392, 436, 437, 443, 444, 449, 451, 505, 513–515, 536, 539, 541, 551, 554, 562–564, 569, 581.1, DIG. 1

[56] References Cited

U.S. PATENT DOCUMENTS

| | | | |
|---|---|---|---|
| D. 93,865 | 11/1934 | Czarnecki | D23/213 |
| D. 235,261 | 6/1975 | Wichman | D23/34 |
| 441,365 | 11/1890 | De Kinder | 239/554 X |
| 699,801 | 5/1902 | Martin | 239/457 |
| 919,737 | 4/1909 | Loomis et al. | 239/451 |
| 1,383,404 | 7/1921 | Kirgan | 239/562 X |
| 1,490,316 | 4/1924 | Dougherty | 239/391 |
| 1,667,964 | 5/1928 | Beddoes | 239/505 |
| 1,742,669 | 1/1930 | Ross | 137/636.1 |
| 1,758,119 | 5/1930 | Le Moon | 239/107 |
| 1,996,159 | 4/1935 | Kittredge | 239/554 X |
| 2,350,086 | 5/1944 | Young | 239/554 |
| 2,619,378 | 11/1952 | Watkins | 299/19 |
| 2,691,549 | 10/1954 | Hayward | 239/443 X |
| 3,171,602 | 3/1965 | Bauchet | 239/515 |
| 3,815,832 | 6/1974 | Floyd | 239/563 |
| 4,316,579 | 2/1982 | Ray | 239/123 |
| 4,579,285 | 4/1986 | Hunter | 239/457 |

FOREIGN PATENT DOCUMENTS

| | | | |
|---|---|---|---|
| 20071 | 12/1928 | Netherlands | 239/554 |
| 7338 | 5/1915 | United Kingdom | 239/554 |

*Primary Examiner*—Lesley D. Morris
*Attorney, Agent, or Firm*—Edward Dreyfus

[57] ABSTRACT

An apparatus is provided for distributing water to a lawn or garden. One or several units may be used to provide for custom watering at any point in the garden. With multiple units stacked, a custom watering pattern may be produced. Each unit has provisions for adjusting the angle of dispersion and the amount of water flow independently of each other.

8 Claims, 4 Drawing Sheets

ADJUSTABLE, STACKABLE WATER SPRINKLER HEAD

This application is a continuation of Ser. No. 08/309,352, filed on Sep. 20, 1994, now abandoned.

FIELD OF THE INVENTION

This invention relates generally to water sprinkling systems and more particularly to an easily adjustable sprinkler head that has the ability to stack several nozzles one on top of the other so that the sprinkling system is able to reach a greater area, thereby watering otherwise unreachable areas between sprinkling units.

BACKGROUND OF THE INVENTION

Invention and use in the subject area is known to the public. Throughout this century there has been an ever increasing demand for an efficient and effective method of water sprinkling for home, industrial and agricultural use. This demand has consistently been met with numerous inventions, each improving upon the last and attempting to provide a better sprinkling device. In 1902, Edmond Martin introduced U.S. Pat. No. 699,801, a Spray Nozzle particularly designed for use as a lawn sprinkler. The device was arranged to conveniently secure a plurality of adjustments for varying the character of the water discharge so as to secure a fine spray and also a broad projected sheet of water in the nature of a fountain. This early art wasted a great deal of water as its shower-like downward projection from high above the ground surface allowed ample time for water evaporation and wind displacement to occur.

Thus, U.S. Pat. No. 1,758,119 to Axel R. Le Moon for a Lawn Sprinkler Nozzle improved upon this art by moving the sprinkling unit from an overhead watering unit to one based at ground level. This device was designed to produce sprays differing in volume and character and also differing in height of discharge point relative to the surface of the ground. It included a spray deflecting attachment for applying to a nozzle for modifying the character and limiting the upward movement of the spray or augmenting its lateral deflection. However, this art still led to much water loss, as the circular nature of its spray meant a large overlap of the sprinkling units in order to cover all the ground surface.

In the 1941 U.S. Pat. No. 2,350,086, Norris and Dorris Young introduced an Irrigating Means employed on the pipe lines of irrigating systems that would improve upon Le Moon's device. The device included four horizontal ring members attached laterally to each other so as to provide an improved sprinkler head which could avoid the problems of uneven water distribution and missed edges or considerably overlapped areas which are often unavoidable with most circular sprinkling units.

Samuel Watkins and James Watson continued to improve upon sprinkling methods with a Spray Nozzle, U.S. Pat. No. 2,619,378 issued in 1947. Watkins and Watson presented an invention that addressed another problem common to circular sprinkling systems by providing a nozzle construction that could be adjusted to spray in a variety of different patterns and angles ranging from full circularity to a small sector of a circle. This eliminated the need to buy several different units to fulfill the needs of different sprinkling angles.

The Static Apparatus for Spraying Liquids, U.S. Pat. No. 3,171,602 was introduced by Pierre Bauchet in 1962. The principal improvement this invention sought to make over prior art was to treat the largest possible surface area with the same apparatus in the form of fine droplets, evenly spread over a surface. The ability to control the water is obtained by mounting a spray cone in adjustable position above the end of the nozzle. The apparatus is screwed on perpendicular to the water inlet pipe, flush with the ground.

In 1974, Malcom Floyd improved upon Watkins and Watson's device with the Sprinkler Apparatus, U.S. Pat. No. 3,815,832. Floyd's device discloses another method for distributing fluid in a spray pattern in a complete circle or any selected segment thereof. This is achieved by means of an upright conduit and a movable cap such that a circumferential row of apertures may be progressively covered or uncovered by movement of the cap.

However, in 1986 Edwin Hunter further improved upon Floyd's device with the Adjustable Sprinkler System, U.S. Pat. No. 4,579,285. Not only does Hunter's invention allow for spraying from an angle of nearly 0 degrees up to 360 degrees, but it also allows the height of the opening to be adjusted. The apparatus is comprised of an adjustable orifice sprinkler unit that includes a tubular body member with a rotatable cap mounted on one end. The cap cooperates with peripheral edges of the tubular body member for defining an adjustable arc spray orifice.

The present invention continues forward in the evolution of sprinkling systems, improving upon all prior art. As with several other prior art systems, the present invention allows for adjusting the water flow to any angle up to 360 degrees. It also allows for the adjustment of the height of the water streams and is designed to cover a large surface area. However, with many of the prior inventions, tools such as a screwdriver are necessary to utilize the features properly. The new invention allows for easy adjustment by hand.

And, unlike the prior art which often calls for numerous units placed throughout the lawn to achieve the desired effects, the new invention reduces the number of sprinkling units and underground piping necessary for ample irrigation by allowing several spray nozzles to be simultaneously stacked vertically on top of one another. With the new invention each stacked unit sprays in a circumference larger than the last, thus one nozzle is effectively able to reach a greater area than any prior art. Up to ten nozzles may be stacked on each riser. In addition, the new invention offers means to independently control the water flow.

And finally, the new invention offers greater versatility than all other prior art in that the sprinkler head can be attached not only to any riser, but also to any hose base or retractable, underground irrigational system. The present invention fulfills these needs and provides further related advantages. Thus it is that none of the prior art offers all of the advantages of the present invention with none of the disadvantages of the prior art. Only the present invention is able to accomplish this.

SUMMARY OF THE INVENTION

The present invention is a sprinkler head apparatus that can house up to ten nozzles stacked vertically, each able to independently spray at a different selected angle in order to reach the maximum amount of ground surface with the minimum number of sprinkler lines and to selectively water certain areas without wasting water where it is not wanted. Inversely, the sprinkler head can also be utilized to attain maximum saturation of a given surface with a minimum amount of sprinkling time.

This great range and saturation is accomplished because each nozzle has its own flow rate and dispersion angle adjustment means. Water is supplied to each unit from a single source, i.e. the main tubular body, in parallel fashion. The adjustment means allow each nozzle to be individually adjusted in order to control the angle, direction and volume of that nozzle's spray. The bottom nozzle is designed to spray water from its borders to a selected area in a selected direction. Each additional stacked nozzle can be used at the same angle as the first nozzle, or at any other desired angle. If each nozzle is set to spray at different distances, the sprinkler head will cover a very large surface area, whereas if each nozzle is set to spray at the same distance, maximum saturation of a given area of the surface will be achieved. The flow rate for each unit is also individually controllable by its own volume control knob.

This is a great improvement over current sprinkler systems. In existing systems it seems that there is always a few spots that are repeatedly missed by the irrigation system. Thus, the user is confronted with two options: either to add more sprinkling units to the system so that each has enough overlap with the others so as to reach the whole of the surface, or to continue to increase the amounts and lengths of time in which the surface is watered. Unfortunately, neither of these options are very appealing, as both lead to added costs for the user and increased waste of water. Thus the new invention's ability to reach and evenly distribute water across large areas with only one unit alleviates these problems rather simply.

The new invention has a relatively simple construction, as it is comprised generally of a base unit which attaches to a threaded riser or the like, a nozzle attachment consisting of an angle adjustment knob, a volume control knob, a snap-stack element for connecting the next nozzle, and a spiral flow feature, and a cap which covers the top most of the nozzle attachments. To add additional nozzles, the cap is removed, another nozzle attachment section is attached to the top of the proceeding one. Once all desired nozzles have been added, the cap is then screwed in place on the topmost unit.

The new invention has a great deal of versatility as it can be easily attached to several different kinds of sprinkling mechanisms. The bottom side of the base unit can be screwed into a riser to aid in farm irrigation techniques or into a hose base to aid in irrigation of lawns that do not have an underground watering line.

The base of the new invention may also be attached to an underground sprinkling mechanism which would allow the unit to be placed underground, in an upright position, so that the top nozzle unit of the invention lies at or slightly below ground surface. The unit would then function so that when the water flow is turned on, the pressure of the forthcoming water forces the entire sprinkler head above ground, thus distributing the water above the ground surface. With this system, when the water flow again ends, the pressure is decreased and the sprinkler head retracts and again lies beneath the ground's surface. This is a convenient way to avoid excessive weathering to the sprinkler head. It also serves as a means of keeping the head safely tucked away from running children, pets, lawn mowers, or anything else that might otherwise inadvertently damage the device.

Thus it is the object of the present invention to utilize several stackable nozzles so as to provide several different streams of water from the same sprinkling location. These streams can be adjusted so that each reaches a different location or all of them reach the same area, or any combination of the two. This aids in fulfilling another object of the invention, which is to eliminate the need to overlap sprinkling units in order to reach all areas of the surface. This reduces some of the ground pipe connections that are otherwise necessary in underground irrigation systems, which in turn works to save money for the user.

Further, it is an object of the new invention to offer the user the greatest selection of watering angles, watering distance and water flow control by constructing each stackable nozzle to individually adjust by means of a adjustable collar. This ability to precisely add and adjust the desired number of nozzles to reach all areas in need of water allows for yet another object of the new invention, which is to reduce the time and amount of water needed to irrigate a given area, thereby leading to lowered water costs.

It is yet another object of the present invention to offer a wide range of uses, including attaching the sprinkler head to a riser to aid in farming irrigation or attaching it to a retractable-type underground sprinkling system to cut back on water overlap. The present invention also can be attached to any shape or size hose base for above-ground irrigation.

Hence, it is an object of the present invention to be of simple construction so that it is both inexpensive to manufacture and easy to install. It is also an object of the present invention to be easily disassembled for cleaning purposes. And still another object is to adjust easily by hand, thus requiring no special tools. Thus it is that the present invention allows for a cost-effective, simply constructed, easy to adjust sprinkler head unit that saves both watering time and money.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
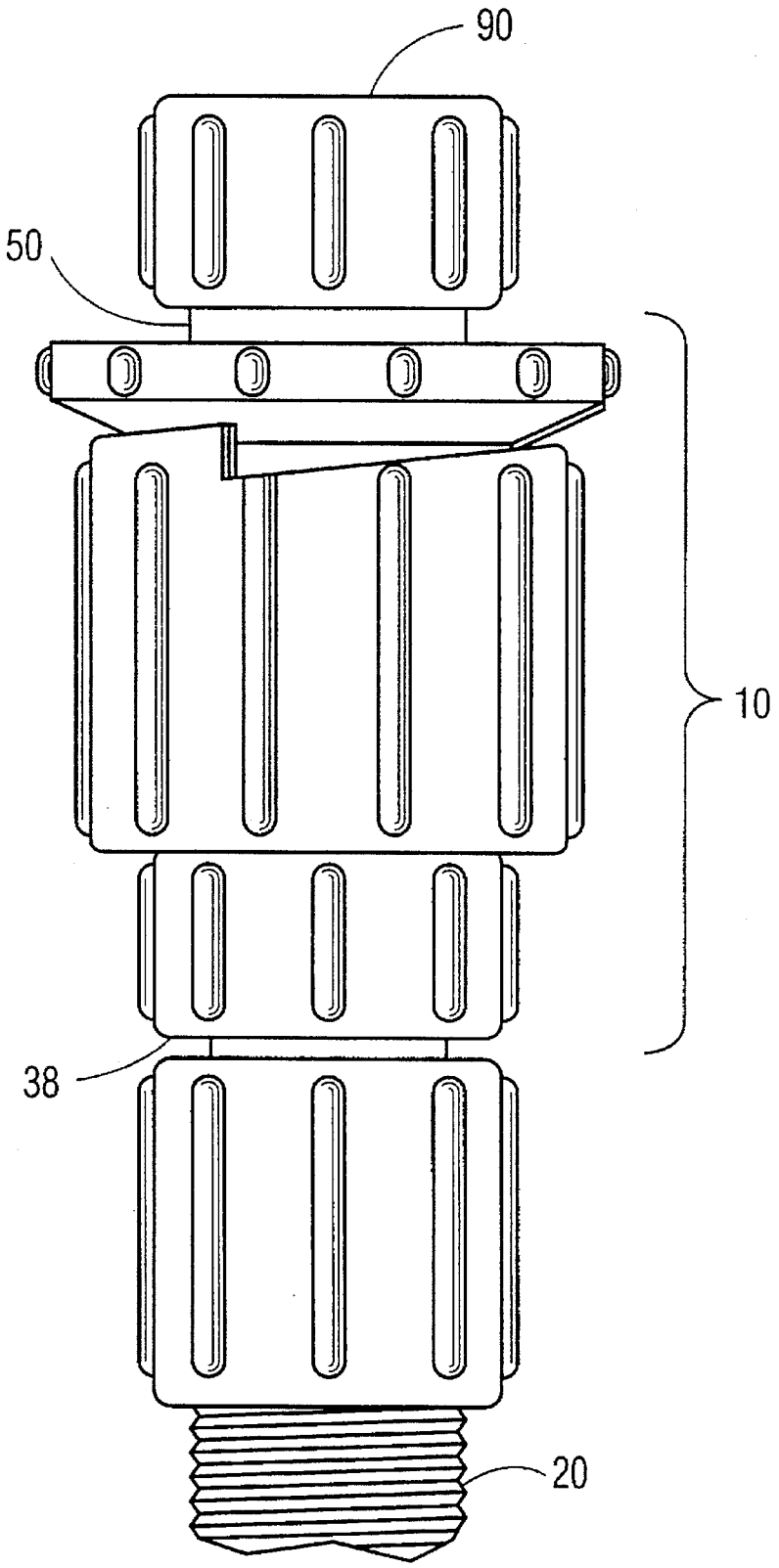
FIG. 1 is a side elevational view of one modular unit of the invention.

FIG. 1 shows a single water dispensing device 10 with a cap 90 attached to a upper end 50 of the body 30 and a water supply bib 20 engaged within a lower end 38 of the body 30.

Figure 2:
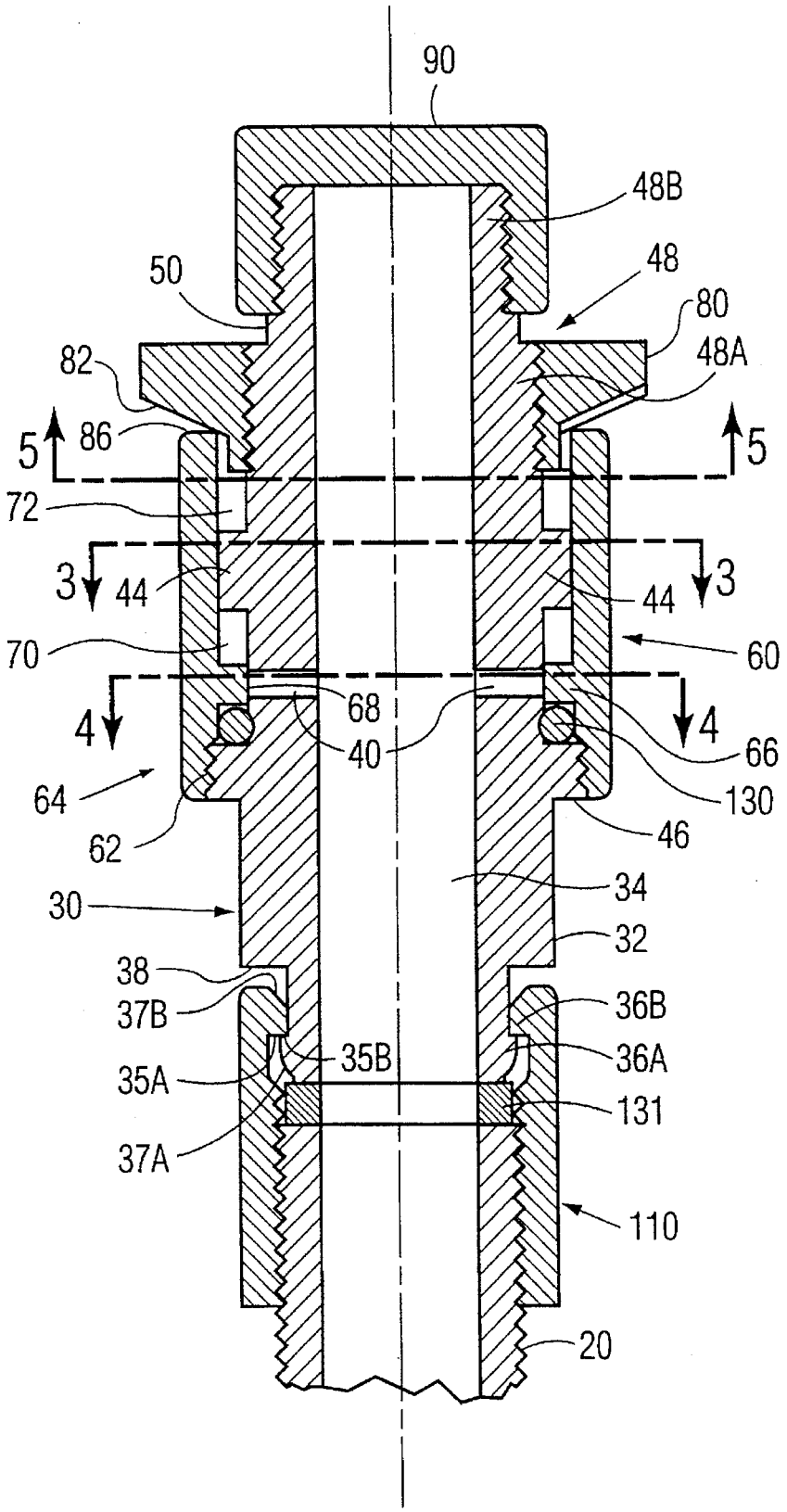
FIG. 2 is a cross-sectional view of the illustration of FIG. 1 showing further interior details.

The water dispensing device 10 includes a vertically oriented, cylindrical body 30 as shown in cross-section in FIG. 2. The body 30 has an exterior surface 32, an axial, central water conduit 34, and a means for attachment of the lower end 38 of the body 30 to a water supply in order to conduct a water flow through the body 30 of the device 10. Preferably, the means for attachment of the lower end 38 of the body 30 to the water supply would be a rotational, threaded means, although snap-on couplings or other like attachment means could also be employed. In the preferred embodiment, when the rotational means for attachment is employed, a first means for rotational attachment 36A would be located at the base of the lower end 38 of the body 30 and extend outwardly from it. A connector 110, with its inner, upper lip forming a second means for rotational attachment 36B, would be attached to the lower end 38 of the body 30. Preferably, this connection would be accomplished by the first and the second means for rotational attachment 36A, 36B, each including an annular angled surface 37A, 37B respectively, and an annular horizontal surface 35A, 35B respectively.

With this method, the angled surfaces 37A, 37B would be sized and positioned for providing mutual engagement, and when pressed together, couple to allow the horizontal surfaces 35A, 35B to engage in rotational interlocked engagement for joining the body 30 and the connector 110 coaxially. Further, the connector, 110, would be threaded so as to accept the threaded water supply bib 20, typically a vertical riser from an underground distribution system or similar device, thus connecting the dispensing device 10 to the water supply and conducting a water flow through the connector 110 and through the body 30.

The device 10 also includes a means for dispersement of at least a portion of the water flow radially outwardly from the device. Preferably, the method employed to disperse the water would be similar to the configuration shown in FIG. 2. In this method, a plurality of passages 40 would be arranged circumferentially in the body 30. The passages 40 would be radially positioned for interconnecting the water conduit 34 with the exterior surface 32. A plurality of separate body embossments 44 that angle in a spiraling manner, would also be arranged circumferentially on the exterior surface 32 and extend radially away from it.

Further, an external threaded portion 46 would be positioned adjacent to the passages 40, and an open ended, vertically oriented, cylindrical valving sleeve 60 would contain an internal threaded portion 62 at a lower end 64 for engaging the external threaded portion 46 of the body 30. The valving sleeve 60 would also include a plurality of interior sleeve embossments 66 extending radially inwardly and each terminating with a concave surface 68. Each of the embossments 66 would be positioned opposite one of the water passages 40 of the body 30. The concave surfaces 68 would be positioned for contacting the exterior surface 32 of the body 30. The embossments 66 of the valving sleeve 60 would be rotationally positionable so as to fully cover, partially cover, or fully uncover the passages 40 in order to control the radially outward flow of water through the passages 40 in the body 30.

With this arrangement, water flow can move past the embossments 66, when moved aside, and enter a lower chamber space 70 formed between the body 30 and the valving sleeve 60. It can then move upwardly between the angled body embossments 44 into a upper chamber space 72 formed between the body 30 and the valving sleeve 60. Further, a water diverting washer 80 would be rotationally threadably engaged with a threaded attachment means 48, provided adjacent to the upper end 50 of the body 30. The water diverting washer 80 and the threaded attachment means 48 would be engaged immediately above the upper chamber space 72. The diverting washer 80 includes a downfacing, upwardly angled annular surface 82 for diverting the upward flow from the second space radially outwardly for disbursement to a lawn or garden.

Further, the downfacing, upwardly angled annular surface 82 would be preferably formed as a spiral surface joined at one radial position 120A (FIG. 5) on the angled surface by a first vertical edge 122A. The valving sleeve thus provides an upfacing annular edge 86 formed as a spiral corresponding to that of the surface 82 so that the two spiral surfaces contact over an angular range determined by the position of the vertical edge 122A. It too would be joined at one radial position 120B on the valving sleeve 60 by a second vertical edge 122B. The upfacing annular edge 86 would form a continuous contact with the angled surface 82 so as to establish a tight fit with it. This prevents water flow from the upper chamber space 72, when the first and second vertical edges 122A, 122B are in contact, and allows passage of water flow from between the angled surface 82 and the upfacing edge 86 over an evenly distributed continuous angle corresponding to whatever angle is included between the vertical edges 122A, 122B when they are drawn apart by rotation of the diverting washer 80 with respect to the body 30, assuming the valving sleeve 60 is rotationally stationary. Repositioning of the valving sleeve 60 on the body 30, in order to change the amount of water flowing from the body 30 into the lower chamber space 70, would also change the angle of dispersement since the angular spacing between the vertical edges 122A, 122B is changed as well.

While the above described embodiment is the preferred means for providing water dispersion radially from the dispensing device 10, there are several other methods that could be employed to fulfill the same water dispersing function as the above described method.

Even further, the device 10 includes a means for attachment of the upper end of the body 50 to a further water dispensing device 10A. The attachment means provides engagement with the further water dispensing device 10A such that the water flow is conducted from the water dispensing device 10 to the further water dispensing device 10A in a vertically upward flow. This attachment can be accomplished by use of several different attachment means, similar to the attachment means between the lower end body 38 of the body 30 and the water supply as detailed above. Preferably then, the means for attachment is a threaded, rotatable device. However, this attachment means may, as shown, consist of two separate threaded sections, a single threaded section, or even other well known means for interconnection of tubular elements, such as friction fittings, clamp fittings etc.

Figure 7:
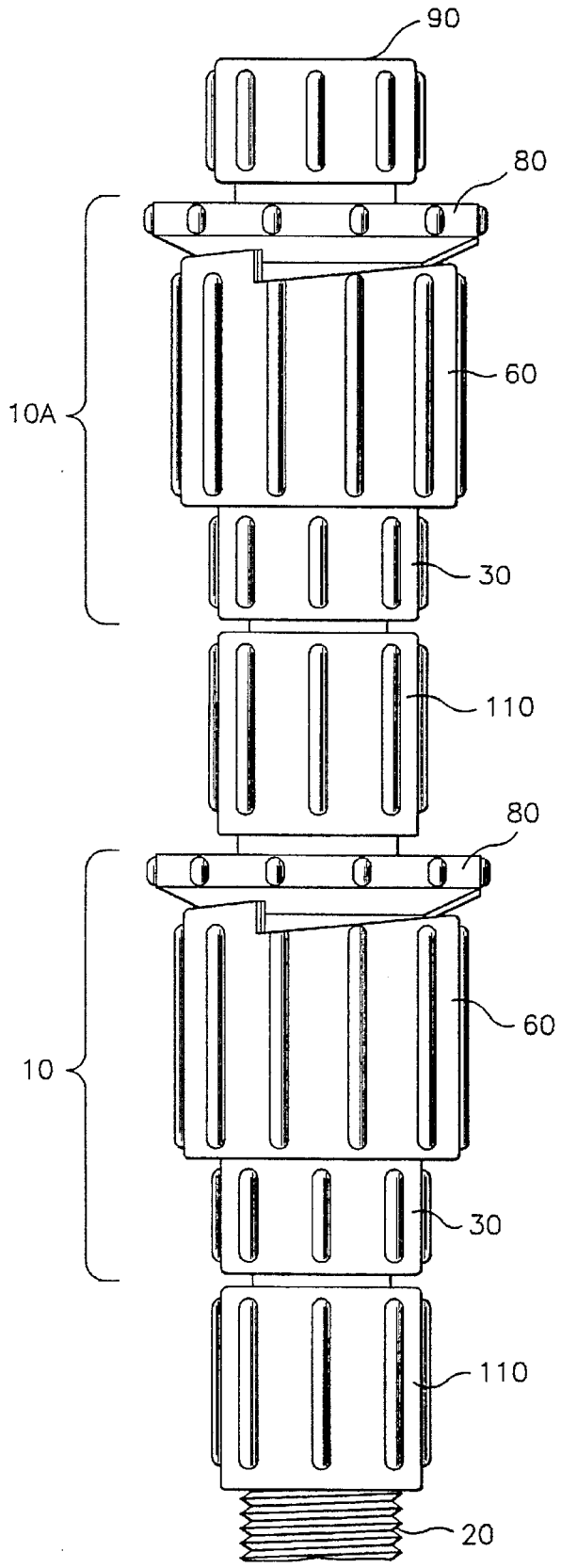
FIG. 7 is a side elevational view of the invention showing the configuration of two units stacked one above the other.

In the embodiment shown in FIG. 2, the threaded attachment means 48, typically a pair of external threaded portions 48A and 48B, on the body 30, would provide a means for engaging the further water dispensing device 10A. And, as seen in FIG. 7, the attachment means 48 engages with the connector 110 of the further dispensing device 10A. This provides a configuration for mounting a second device 10A on top of the first dispensing device 10. In this way the devices 10 may be stacked from one to several high to enable the sprinkling of a lawn from each of, up to several, units from the same location on the lawn.

When the desired number of dispensing devices 10 have been stacked and attached to one another, a cap 90 may be attached to the threaded means 48 of the uppermost dispensing device 10, thus closing the upper end 50 of the body 30.

FIG. 2 also shows that the preferable assembly includes O-ring 130 for preventing water flow downwardly from water passages 40. A sealing gasket 131 would typically be used for sealing the connection between bib 20 and the body 30.

Figure 6:
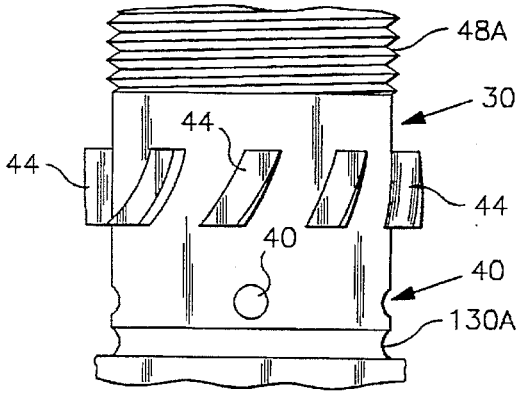
FIG. 6 is a partial side view of the main body of the invention.
Figure 3:
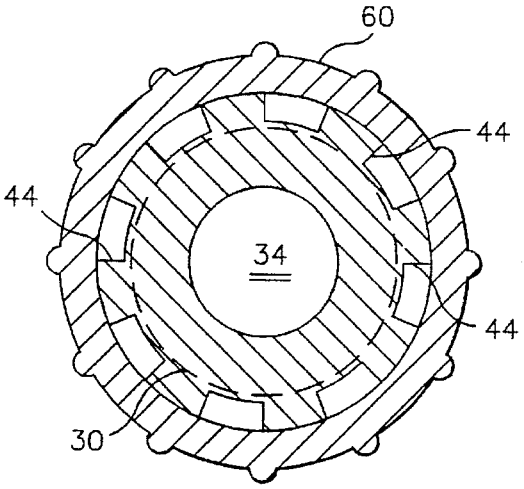

FIG. 3, a cross sectional view taken along lines 3—3 in FIG. 2 shows the location of the valving sleeve 60 relative to the body 30. The angled body embossments 44 are indicated. Note that the spaces between these embossments 44 control the direction and to some extent the amount of water upflow. In FIG. 6, the embossments 44 are shown to be preferably angled and spiraled in nature to provide a spiral flow of the upflowing water.

Figure 4:
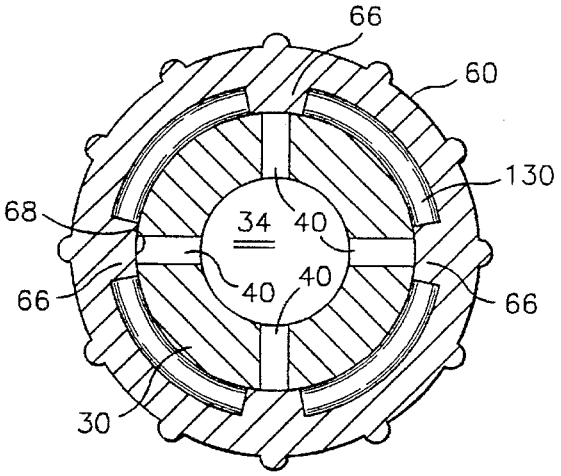

FIG. 4, a cross sectional view taken along lines 4—4 in FIG. 2 shows the location of the valving sleeve 60 relative to the body 30. The radial passages 40 are indicated. Interior sleeve embossments 66 are shown as well. Note that the O-ring 130 may be seen in the spaces between these embossments. The adjustment of sleeve 60 controls the amount of water flowing out of conduits 40.

Figure 5:
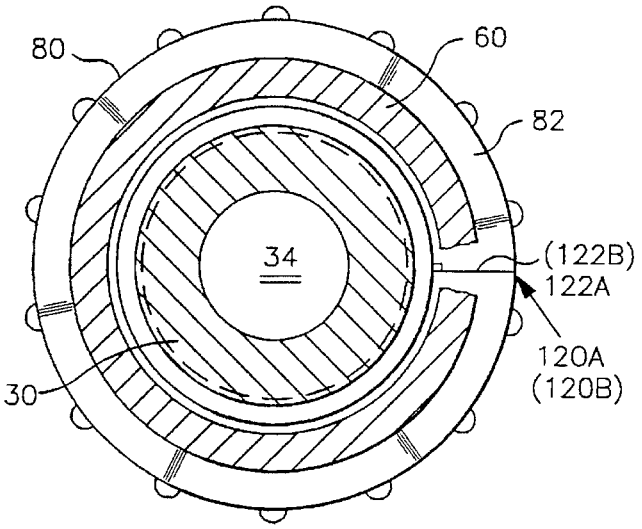
FIGS. 3, 4, and 5 are cross-sectional views of the invention taken from FIG. 2 showing various plan view details.

FIG. 5, a cross sectional view taken along lines 5—5 in FIG. 2 shows the location of the valving sleeve 60 relative to the body 30 and the diverting washer 80.

FIG. 6 is an elevational side view of the body showing details including the embossments 44, the radial passages 40 preferably in quadrature orientation, a groove 130A for placement of O-ring 130 and the threaded portion that makes up attachment means 48A.

FIG. 7 shows how two devices 10 may be mounted one above the other. Additional devices 10 could be mounted as well.

The amount of water flow admitted to annular upper chamber space 70 is determined by the angular position of valving sleeve 60 relative to the passages 40. The direction of disbursement from the nozzle assembly is primarily dictated by the position of the assembly on the bib 20 or riser. This is easily selected by simply rotating the device 10 to any desired angle, since the connector sleeve 110 is position insensitive. The inclusive angle of spray is determined by the rotational position of the diverting washer 80 with respect to the body 30, in that the opening between vertical edges 122A and 122B is increased when the vertical edges 122A and 122B are drawn apart by rotation of the diverting washer 80 with respect to the body 30.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A lawn sprinkler nozzle assembly for attachment to a water supply bib comprising:

a vertically oriented, cylindrical body having an exterior surface, an axial, central water conduit, a first means for rotational attachment of a lower end of the body to the water supply bib, a plurality of passages arranged circumferentially in the body, radially interconnecting the water conduit with the exterior surface, a plurality of separate angled body embossments arranged circumferentially on the exterior surface and extending radially away therefrom, an external threaded portion adjacent the passages, and a threaded attachment means adjacent to an upper end of the body;

an open ended, vertically oriented, cylindrical valving sleeve having an internal threaded portion at a lower end thereof engaging the external threaded portion of the body, and a plurality of interior sleeve embossments extending radially inwardly each terminating with a concave surface, each of the embossments positioned opposite one of the water conduits of the body, the concave surfaces contacting the exterior surface of the body, the embossments of the valving sleeve being rotationally positionable so as to control a radially outward flow of water through the passages in the body, said flow entering a lower space formed between the body and the valving sleeve to move upwardly between the angled body embossments into a second space formed between the body and the valving sleeve, adjacent an upper open end of the valving sleeve;

a water diverting washer rotationally threadably engaged with the threaded attachment means in a position immediately above the second space formed between the body and the valving sleeve, the diverting washer including a downfacing, upwardly angled annular surface for diverting the upward flow from the second space radially outwardly therefrom for disbursement thereof.

2. The lawn sprinkler nozzle of claim 1 wherein the cylindrical body is open at an upper end thereof, the threaded attachment means being engaged by a threaded cap for closing the upper end.

3. The lawn sprinkler nozzle of claim 1 wherein the cylindrical body is open at an upper end thereof, the threaded attachment means being engaged by a threaded connector providing a second means for rotational attachment configured for engaging the first means for rotational attachment of the body thereby providing a configuration for mounting a second lawn sprinkler nozzle assembly on top of a first lawn sprinkler nozzle assembly.

4. The lawn sprinkler nozzle of claim 3 wherein the first and the second means for rotational attachment each include an annular angled surface, and a annular horizontal surface, the angled surfaces being positioned for providing mutual engagement of the horizontal surfaces in rotational interlocked engagement for joining the body and the threaded connector coaxially.

5. The lawn sprinkler nozzle of claim 1 wherein the downfacing, upwardly angled annular surface is formed as a spiral joined at one radial position on the angled surface by a first vertical edge, further, the valving sleeve provides an upfacing annular edge formed as a corresponding spiral joined at one radial position on the valving sleeve by a second vertical edge, the upfacing annular edge forming continuous contact with the angled surface so as to establish a tight fit thereagainst for preventing water flow from the second space, when the first and second vertical edges are in contact, and providing disbursement of water flow from between the angled surface and the upfacing lip over an evenly distributed continuous angular corresponding to an angle included between the vertical edges when drawn apart by rotation of the diverting washer with respect to the body.

6. A water dispensing device comprising:

a vertically oriented, cylindrical body providing an axial, central water conduit, the body having a lower end having a means for attachment of the lower end of the body to a water supply for conducting a water flow through the body, a means for disbursement of at least a portion of the water flow radially outward from the device, the body having an upper end having a threaded attachment means, for stacking a further water dispensing device, the further water dispensing device having an internally threaded connector for engagement therewith such that the water flow is conducted from the water dispensing device to the further water dispensing device in a vertically upward flow, and further comprising a cylindrical valving sleeve which is rotatable about the cylindrical body for adjusting water flow from the body.

7. The water dispensing device as recited in claim 6, wherein the internally threaded connector is identical to the means for attachment of the lower end of the body to the water supply.

8. The water dispensing device as recited in claim 7, wherein:

the means for disbursement further comprises a plurality of water passages arranged circumferentially in the body, the water passages connected to the central conduit; and wherein the cylindrical valving sleeve has a plurality of interior sleeve embossments extending radially inward, the cylindrical valving sleeve can be rotated to selectively cover all of the water passages simultaneously by the interior sleeve embossments.

* * * * *